US007051373B1

(12) United States Patent
Krall

(10) Patent No.: US 7,051,373 B1
(45) Date of Patent: May 30, 2006

(54) BREAST POCKET FOR SWEATSHIRTS AND METHOD OF MANUFACTURING

(76) Inventor: Michael A. Krall, 17040 Crestview Dr., Victorville, CA (US) 92392

( * ) Notice: Subject to any disclaimer, the term of this patent is extended or adjusted under 35 U.S.C. 154(b) by 155 days.

(21) Appl. No.: 10/762,042

(22) Filed: Jan. 21, 2004

(51) Int. Cl.
*A41D 13/00* (2006.01)

(52) U.S. Cl. ..... 2/69

(58) Field of Classification Search ..... 2/69, 2/227, 228, 115, 94, 102, 108, 247–252
See application file for complete search history.

(56) References Cited

U.S. PATENT DOCUMENTS

| | | | | |
|---|---|---|---|---|
| 1,551,059 | A | 8/1925 | Schnellbacher | |
| 2,058,801 | A | 10/1936 | Kamil | |
| 2,609,541 | A | 9/1952 | Kaplan | |
| 2,677,131 | A | 5/1954 | Shuster | |
| 3,602,914 | A | 9/1971 | Castello | |
| 4,062,064 | A | 12/1977 | Vosatka | |
| 4,791,681 | A | 12/1988 | Dean | |
| 5,222,259 | A * | 6/1993 | Bristor | 2/115 |
| 5,561,860 | A | 10/1996 | Nguyen-Senderowicz | |
| 5,642,526 | A * | 7/1997 | Thompson | 2/79 |
| 6,175,960 | B1 * | 1/2001 | Knittel | 2/115 |
| 6,397,395 | B1 * | 6/2002 | DeHart | 2/206 |
| 6,477,710 | B1 * | 11/2002 | Ojoyeyi | 2/69 |

* cited by examiner

*Primary Examiner*—Tejash Patel

(57) ABSTRACT

A breast pocket for sweatshirts and method of manufacturing for enhancing the usefulness of the sweatshirt and facilitating carrying user accessories. The assembly includes a main portion and a pouch member. The main portion includes a front panel, a back panel, a neck opening and pair of arm openings. The front panel also has a slit therein. The slit is preferably positioned over either the right or left breast of the user when the main portion is being worn. The pouch member has an opening. Most preferably the opening of the pouch member is operationally coupled to the slit of the front panel. The pouch member is preferably positioned to abut an interior portion of the front panel. A closure device may be provided to selectively close the opening of the pouch member.

16 Claims, 3 Drawing Sheets

BREAST POCKET FOR SWEATSHIRTS AND METHOD OF MANUFACTURING

BACKGROUND OF THE INVENTION

1. Field of the Invention

The present invention relates to articles of apparel and more particularly pertains to a new breast pocket for sweatshirts and method of manufacturing for enhancing the usefulness of sweatshirts.

2. Description of the Prior Art

The range of styles of articles of apparel is extremely broad. Yet, the ubiquitous sweatshirt seems to be present almost every wardrobe throughout the county. Sweatshirts serve as a means to convey messages if support for schools, churches, athletic teams, movies, philosophies, and a wide range of other concerns. Some of the various styles of sweatshirts include hand-warmer pockets positioned on the front of the garment adjacent to the stomach of the user.

The use of pockets in articles of apparel is known in the prior art. Illustrative examples include: U.S. Pat. No. 4,062,064; U.S. Pat. No. 4,791,681; U.S. Pat. No. 3,602,914; U.S. Pat. No. 2,609,541; U.S. Pat. No. 1,551,059; U.S. Pat. No. 2,677,131; U.S. Pat. No. 2,058,801; and U.S. Pat. No. 5,561,860.

While these devices fulfill their respective, particular objectives and requirements, the need remains for a pocket which provides a secure means of storage for user accessories, without detracting from logos, indicia, graphics, or general aesthetics of an article of apparel.

SUMMARY OF THE INVENTION

The present invention meets the needs presented above by providing a pouch type pocket positioned on an interior of the garment and minimizing the visual observability of the pocket.

One advantage of the present invention is its layered construction with the article of apparel minimizing the potential for bunching or puckering of the outside surface of the article of apparel.

Another advantage of the present invention is the slit design of the opening in the front of the article of apparel further minimizing the visual outline of the pocket.

To this end, the present invention generally comprises a main portion and a pouch member. The main portion includes a front panel, a back panel, a neck opening and pair of arm openings. The front panel also has a slit therein. The slit is preferably positioned over either the right or left breast of the user when the main portion is being worn. The pouch member has an opening. Most preferably the opening of the pouch member is operationally coupled to the slit of the front panel. The pouch member is preferably positioned to abut an interior portion of the front panel. A closure device may be provided to selectively close the opening of the pouch member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
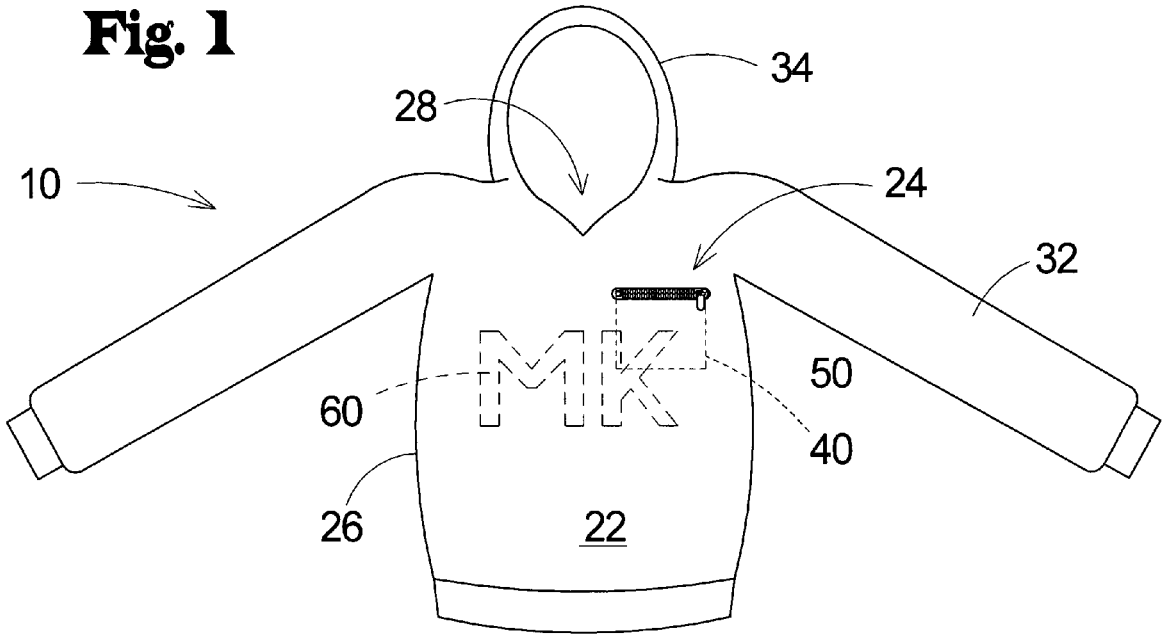
FIG. 1 is a schematic perspective view of a new breast pocket for sweatshirts and method of manufacturing according to the present invention.
Figure 2:
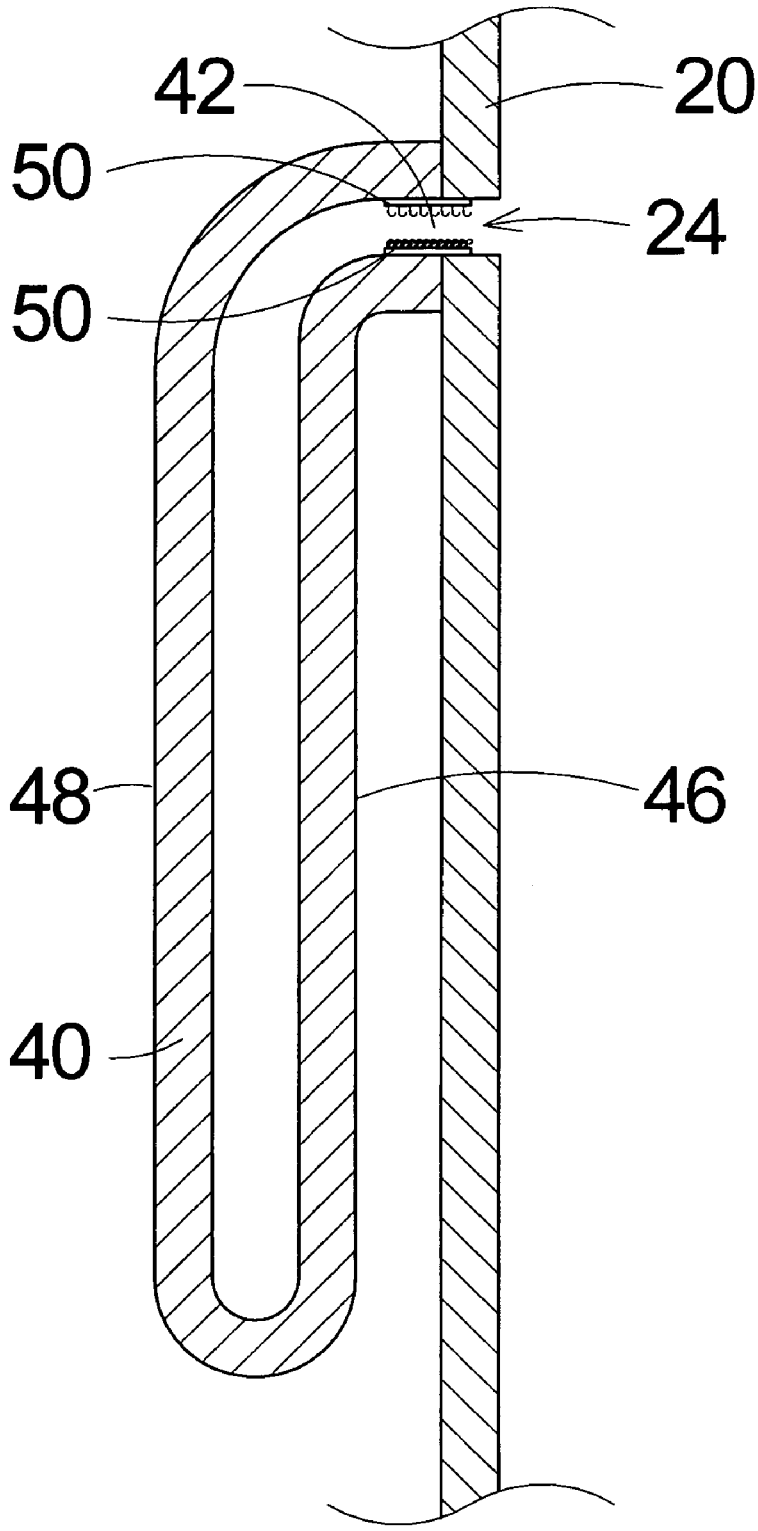
FIG. 2 is a schematic side view of the pouch member of the present invention.
Figure 3:
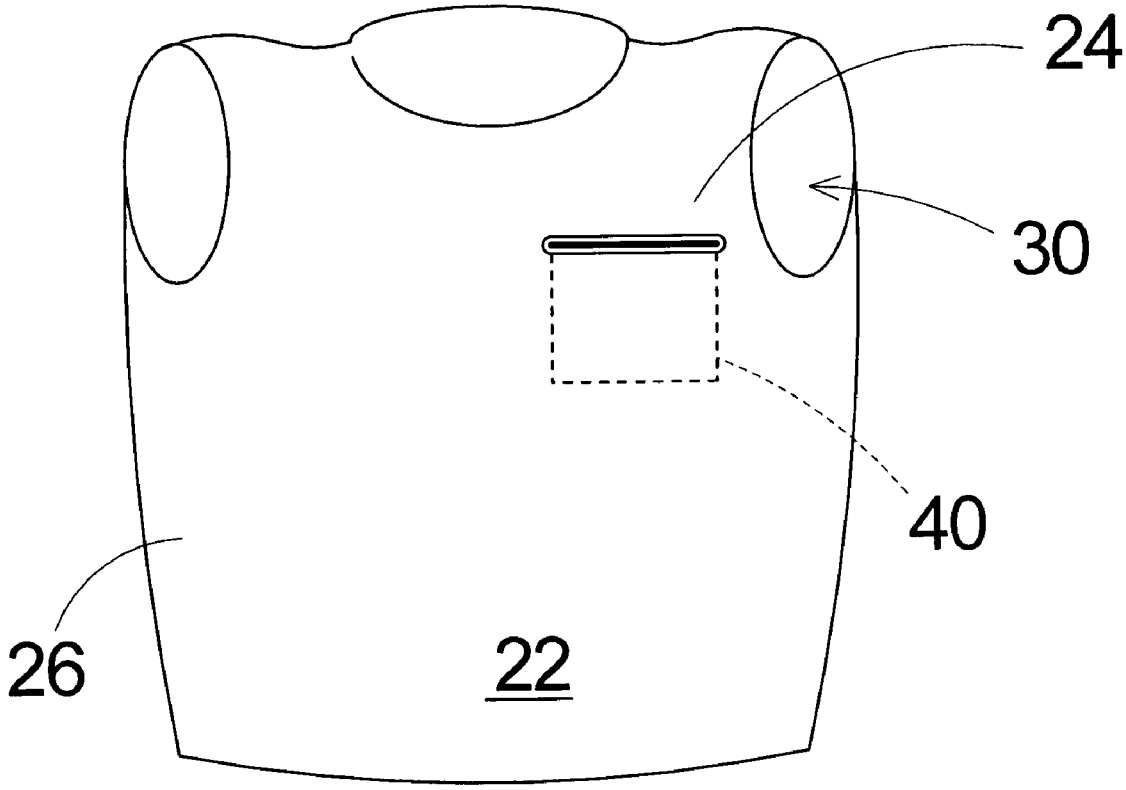
FIG. 3 is a schematic front view of the sweatshirt of the present invention.

With reference now to the drawings, and in particular to FIGS. 1 through 3 thereof, a new breast pocket for sweatshirts and method of manufacturing embodying the principles and concepts of the present invention and generally designated by the reference numeral 10 will be described.

As best illustrated in FIGS. 1 through 3, the breast pocket for sweatshirts and method of manufacturing 10 generally comprises a main portion 20 and a pouch member 40.

The main portion 20 includes a front panel 22, a back panel 26, a neck opening 28 and pair of arm openings 30. The front panel 22 also has a slit 24 therein. The slit 24 is preferably positioned over either the right or left breast of the user when the main portion 20 is being worn.

The pouch member 40 has an opening 42. Most preferably the opening 42 of the pouch member 40 is operationally coupled to the slit 24 of the front panel 20. The pouch member 40 is preferably positioned to abut an interior portion of the front panel 22.

In at least one embodiment a closure means 50 is provided to selectively close the opening 42 of the pouch member 40.

Preferred implementations of the closure means 50 include a button/button hole pair, a snap, a zipper, and hook and loop fastener, although other suitable devices may be used with satisfactory results.

In an embodiment, the opening 42 of the pouch member 40 is secured to and aligned with the slit 24 in the front panel 22 by stitching a perimeter edge of the pouch member 40 encompassing the opening 42 to a perimeter edge of the slit 24 in the front panel 22.

A pair of arm portions 32 may be operationally secured to the main portion 22. Each one of the pair of arm portions 32 is aligned with an associated one of the pair of arm openings 30.

A hood 34 may also be operationally coupled to the main portion 20.

In at least one embodiment an indicia 60 is positioned on the front panel 22. Preferably, the slit 24 has a very small vertical width limiting its visual observability with regard to the indicia 60.

In a preferred embodiment, the pouch member 40 further comprises a pouch front portion 46 and a pouch back portion 48. The pouch front portion 46 is operationally coupled to the pouch back portion 48 along a bottom edge and two side edges. The top edge is adjacent to the opening. The pouch front portion 46 abuts the interior surface of the front panel 22. The pouch back portion 48 abuts a chest of a user when the sweatshirt 20 is being worn by the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sweatshirt comprising:

a main portion having a front panel, a back panel, a neck opening and pair of arm opening;

said front panel having a slit therein, said slit forming a pair of opposed edges on said front panel; and a pouch member having an opening, said opening of said pouch member being operationally coupled to said slit of said front panel, said pouch member being positioned abutting an interior portion of said front panel; and a closure means for selectively closing said slit in said front panel and said opening of said pouch member, said closure means being located on said opposed edges of said slit.

2. The sweatshirt of claim 1, wherein said closure means further comprises a closure device selected from the group of closure devices consisting of a button/button hole pair, a snap, a zipper, and hook and loop fastener.

3. The sweatshirt of claim 1, wherein said opening of said pouch member being secured to and aligned with said slit in said front panel by stitching a perimeter edge of said pouch member encompassing said opening to a perimeter edge of said slit in said front panel.

4. The sweatshirt of claim 1, further comprising a pair of arm portions operationally secured to said main portion, each one of said pair of arm portions being aligned with an associated one of said pair of arm openings.

5. The sweatshirt of claim 1, further comprising a hood operationally coupled to said main portion.

6. The sweatshirt of claim 1, further comprising an indicia positioned on said front panel.

7. The sweatshirt of claim 1, wherein said pouch member further comprises a pouch front portion and a pouch back portion, said pouch front portion being operationally coupled to said pouch back portion along a bottom edge and two side edges, said top edge being adjacent to said opening, said pouch front portion abutting the interior surface of the front panel, said pouch back portion abutting a chest of a user when said sweatshirt is being worn by the user.

8. The sweatshirt of claim 1, further comprising:

said opening of said pouch member being secured to and aligned with said slit in said front panel by stitching a perimeter edge of said pouch member encompassing said opening to a perimeter edge of said slit in said front panel; and said pouch member further comprises a pouch front portion and a pouch back portion, said pouch front portion being operationally coupled to said pouch back portion along a bottom edge and two side edges, said top edge being adjacent to said opening, said pouch front portion abutting the interior surface of the front panel, said pouch back portion abutting a chest of a user when said sweatshirt is being worn by the user;

wherein said closure means does not extend through said slit of said front panel;

wherein said opening of said pouch member is defined by opposed edge portions of the pouch member, and said closure means bridges between said opposed edges of said slit and said opposed edge portions of said pouch member;

wherein said closure means comprises a pair of strips of complementary hook and loop fastener components, and each of said strips is positioned across a respective edge of said front panel and edge portion of said pouch member; and wherein said front panel of said main portion has an interior surface, and said opening of said pouch member is defined by a pair of edge surfaces, said edge surfaces of said pouch member being abutted against said interior surface of said front panel of said main member.

9. A pocket assembly for use on an article of apparel having a front panel and a slit extending therethrough, said slit forming a pair of opposed edges on said front panel, said assembly comprising a pouch member operationally coupled to and interior surface of the front panel, said pouch member having an opening, said opening being aligned with the slit to permit access from the outside of the article of apparel into the pouch member, a closure means for selectively closing said slit in said front panel and said opening of said pouch member, said closure means being located on said opposed edges of said slit.

10. The pocket assembly of claim 9, wherein said closure means further comprises a closure device selected from the group of closure devices consisting of a button/button hole pair, a snap, a zipper, and hook and loop fastener.

11. The pocket assembly of claim 9, wherein said opening of said pouch member being secured to and aligned with said slit in said front panel by stitching a perimeter edge of said pouch member encompassing said opening to a perimeter edge of said slit in said front panel.

12. The pocket assembly of claim 9, wherein said pouch member further comprises a pouch front portion and a pouch back portion, said pouch front portion being operationally coupled to said pouch back portion along a bottom edge and two side edges, said top edge being adjacent to said opening, said pouch front portion abutting the interior surface of the front panel of the article of apparel, said pouch back portion abutting a chest of a user when the article of apparel is being worn by the user.

13. The sweatshirt of claim 1 wherein said closure means does not extend through said slit of said front panel.

14. The sweatshirt of claim 1 wherein said opening of said pouch member is defined by opposed edge portions of the pouch member, and said closure means bridges between said opposed edges of said slit and said opposed edge portions of said pouch member.

15. The sweatshirt of claim 14 wherein said closure means comprises a pair of strips of complementary hook and loop fastener components, and each of said strips is positioned across a respective edge of said front panel and edge portion of said pouch member.

16. The sweatshirt of claim 1 wherein said front panel of said main portion has an interior surface, and said opening of said pouch member is defined by a pair of edge surfaces, said edge surfaces of said pouch member being abutted against said interior surface of said front panel of said main member.

* * * * *